US008459173B2

(12) United States Patent
Liang

(10) Patent No.: US 8,459,173 B2
(45) Date of Patent: Jun. 11, 2013

(54) BIDIRECTIONAL HYDRAULIC SYSTEM FOR OPERATING TABLE

(75) Inventor: Jyh-Wei Liang, Alexandria, VA (US)

(73) Assignee: Amtai Medical Equipment, Inc., Raleigh, NC (US)

( * ) Notice: Subject to any disclaimer, the term of this patent is extended or adjusted under 35 U.S.C. 154(b) by 1005 days.

(21) Appl. No.: 12/500,992

(22) Filed: Jul. 10, 2009

(65) Prior Publication Data

US 2011/0005217 A1 Jan. 13, 2011

(51) Int. Cl.
*F15B 11/16* (2006.01)
*F01B 25/04* (2006.01)

(52) U.S. Cl.
USPC ..... 91/536; 91/1

(58) Field of Classification Search
USPC ..... 91/536
See application file for complete search history.

(56) References Cited

U.S. PATENT DOCUMENTS 4,308,892 A * 1/1982 Van Ausdal ..... 137/625.23
4,325,127 A * 4/1982 Major ..... 91/275
4,966,065 A * 10/1990 Wardle ..... 91/536

* cited by examiner

*Primary Examiner* — F. Daniel Lopez
(74) *Attorney, Agent, or Firm* — Leong C. Lei

(57) ABSTRACT

A bidirectional hydraulic system for operating table is disclosed, which has a switch valve connecting a bidirectional hydraulic pumping device with movable units of an operating table. The switch valve is driven by a motor, and has a valve block defining at least three outbound valve positions on the valve block's top surface, which is parallel to the inside bottom of the base, which the valve block is attached to, and thereof for controlling oil inlet and oil outlet. The switch valve switches among the outbound valve positions for respectively forming oil passages between the bidirectional hydraulic pumping device and hydraulic cylinders of the movable units.

7 Claims, 7 Drawing Sheets

BIDIRECTIONAL HYDRAULIC SYSTEM FOR OPERATING TABLE

BACKGROUND OF THE INVENTION (a) Field of the Invention

The present invention relates to a bidirectional hydraulic system for operating table, and particularly to a bidirectional hydraulic system for operating table which has a switch valve connecting a bidirectional hydraulic pumping device with hydraulic cylinders of movable units of the table for switching hydraulic pressure to the cylinders.

(b) Description of the Prior Art

Movable units of a conventional operating table, for example multi-sectional tabletop rotation, tabletop sliding, descending and ascending, and table locking, are generally powered by a hydraulic system with electromagnetic valves for switching oil passages. The hydraulic cylinder of each movable unit needs at least two electromagnetic valves. In the case that an operating table has multiple hydraulic cylinders, cost will rise proportionally. On the other hand, when a driving circuit or a coil of an electromagnetic valve is out of order, the hydraulic cylinder coupled to the electromagnetic valve will be out of work. Accordingly, a rotary hydraulic valve is put forward to replace the electromagnetic valve for switching oil passages. The rotary hydraulic valve is driven only by a motor, which is economical. When the motor of the rotary hydraulic valve is out of work, valve positions can be chosen manually, thereby increasing reliability.

However, the rotary hydraulic valve is polygonal, and all of the valve positions and oil passages are arrayed radically with a center of a shaft hole. This structure facilitates manufacturing of the rotary hydraulic valve. The rotary hydraulic valve is taller than the electromagnetic valve, so higher space is required for mounting the rotary hydraulic valve onto the operating table. Increased thickness of a base of the operating table has vital influence upon ascending and descending movement of the tabletop. An operating table with four telescopic sleeves is set as an example herein. A table base decreasing one centimeter in thickness, may increase each telescopic sleeve one centimeter in length. In other words, four sleeves may increase four centimeters in length totally. Such a rotary hydraulic valve is undesired for the up and down movement of tabletop.

The conventional rotary hydraulic valve fixes an oil conduit joint onto a downward oil hole with oil conduit screws before locking onto a valve fixation plate. The valve and the valve fixation plate are then both mounted on the base of the operating table. When service is required, the whole rotary hydraulic valve with the valve fixation plate is removed, and then the valve fixation plate has to be detached so as to remove the oil conduit fixed on the oil hole. It is inconvenient and costs extra for having the valve fixation plate.

SUMMARY OF THE INVENTION

A main object of the present invention is to provide a bidirectional hydraulic system for operating table, wherein movable units of an operating table, which are driven by hydraulic cylinders, connect with a bidirectional hydraulic pumping device via a switch valve, such that the bidirectional hydraulic pumping device is switchable in a rotary fashion for controlling oil supply to a selected outbound valve position of the switch valve.

According to one aspect of the present invention, a servo motor or a stepping motor is used to drive a rotating shaft of the switch valve, such that the bidirectional hydraulic pumping device can switch among its oil passages with the correct outbound valve position of the switch valve.

According to another aspect of the present invention, the bidirectional hydraulic system for operating table is mountable into a thin base of an operating table. A valve block of the switch valve has no downward oil hole. A shaft hole and a rotating shaft of the switch valve need not to be located at the center of the valve block. The distance from the shaft hole and the rotating shaft to a bottom surface of the valve block decreases, and therefore reduces overall height of the switch valve and thickness of the base of the operating table.

According to another aspect of the present invention, a motor is used to drive the rotating shaft of the switch valve. A valve detecting element is mounted on an end of the rotating shaft. The valve detecting element includes detectors, and detecting plates respectively corresponding to an individual detector. The valve detecting element can be applied for decoding and controlling the rotating shaft to be precisely positioned to the corresponding oil passages of the outbound valve positions.

According to another aspect of the present invention, the bidirectional hydraulic system for operating table has a knob mounted on the rotating shaft of the switch valve thereof. The knob is rotatable manually from the base's exterior. The knob serves as a manual operating part while the motor of the switch valve is out of work.

According to another aspect of the present invention, the switch valve is fixed on the base of the operating table without extra metal plate, thereby decreasing cost enormously.

To enable a further understanding of the said objectives and the technological methods of the invention herein, the brief description of the drawings below is followed by the detailed description of the preferred embodiments.

DESCRIPTION OF THE PREFERRED EMBODIMENTS

Figure 1:
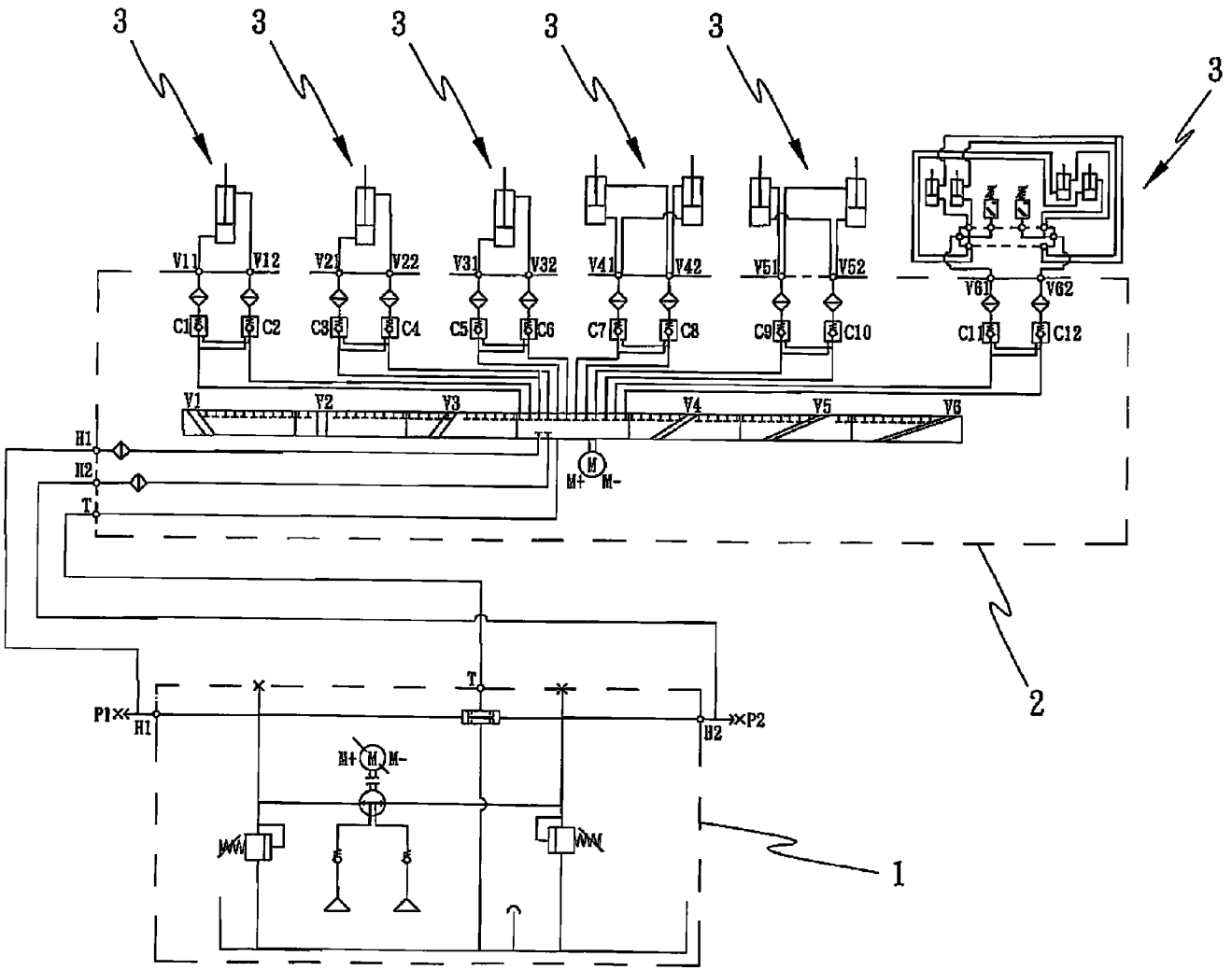
FIG. 1 is a schematic diagram of a circuit of a bidirectional hydraulic system according to the present invention.
Figure 2:
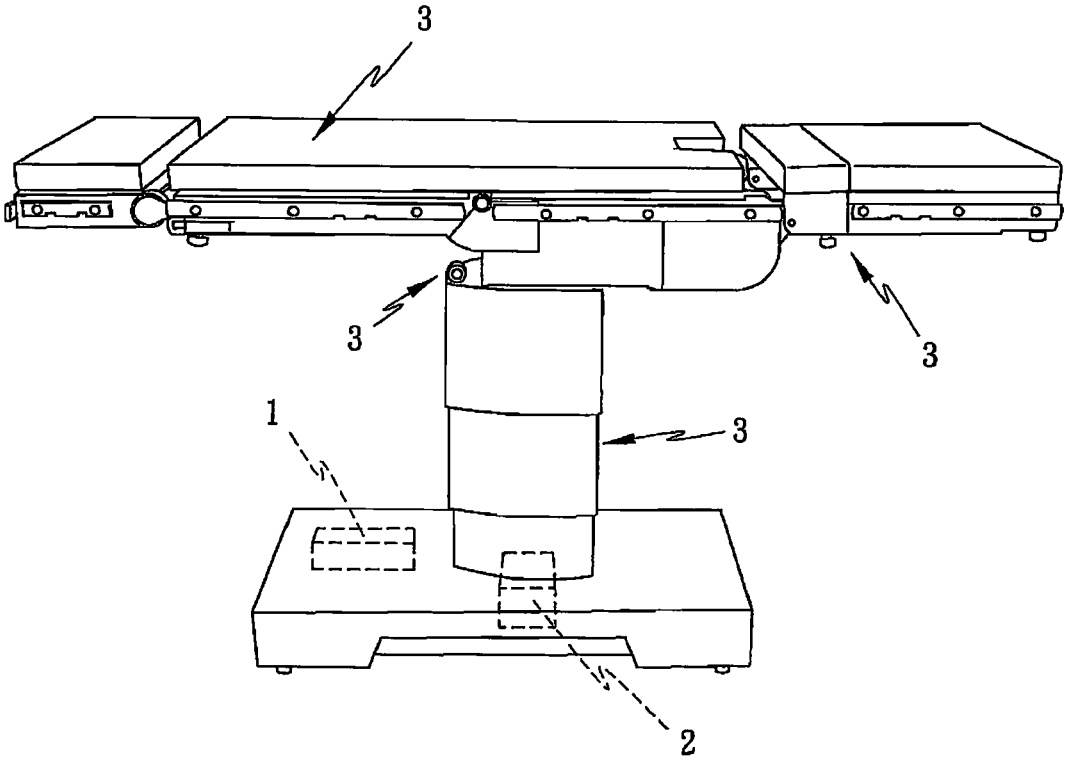
FIG. 2 schematically shows a bidirectional hydraulic system of the present invention applied to an operating table.

With reference to FIGS. 1 and 2, a bidirectional hydraulic system for operating table according to the present invention comprises a bidirectional hydraulic pumping device 1 mounted in a base of an operating table (not labeled), a switch valve 2, and at least three movable units 3 of the operating table.

The bidirectional hydraulic pumping device 1 supplies hydraulic power to the movable units 3 of the operating table.

Figure 3:
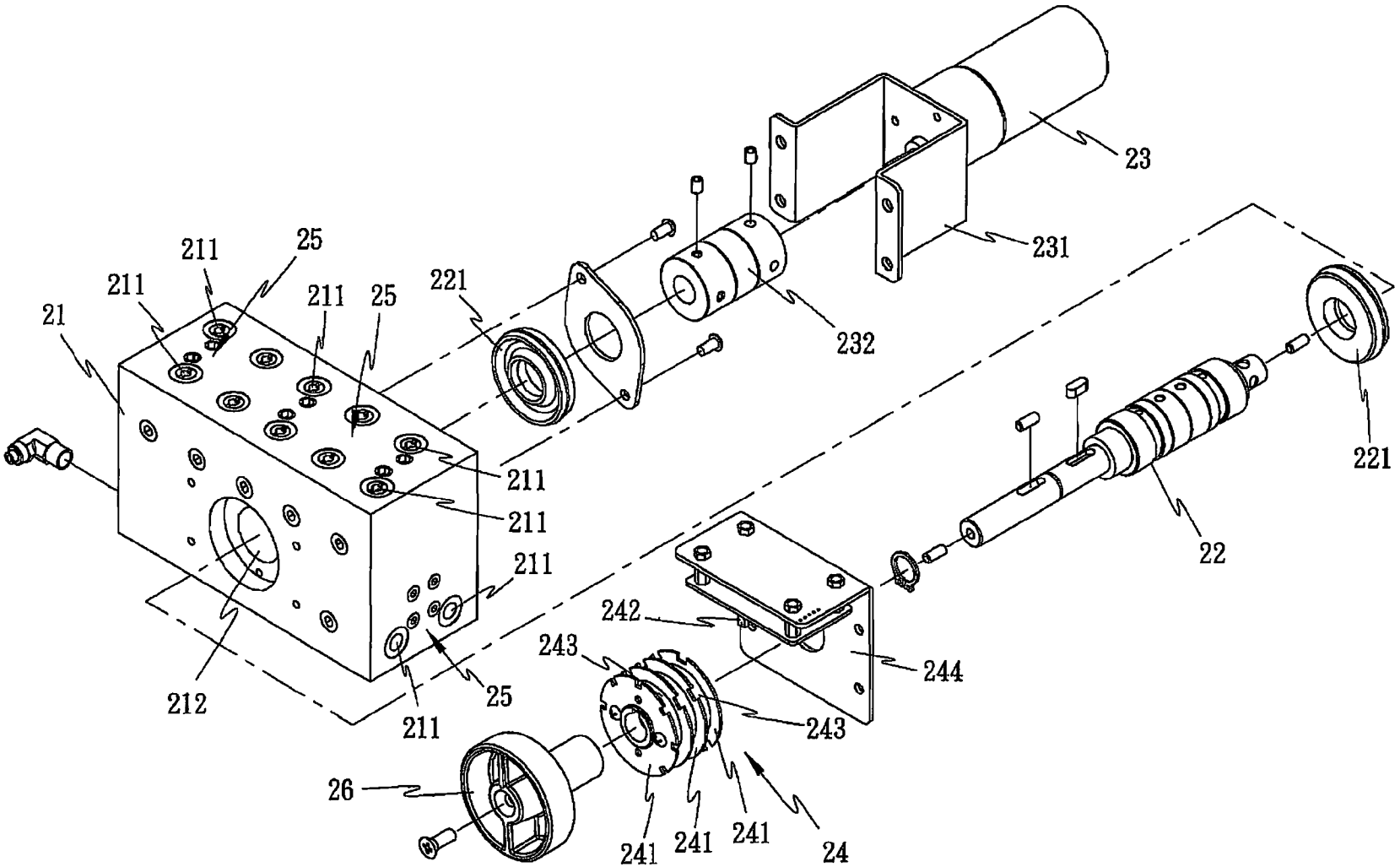
FIG. 3 is an exploded view of a switch valve of the present invention.
Figure 4:
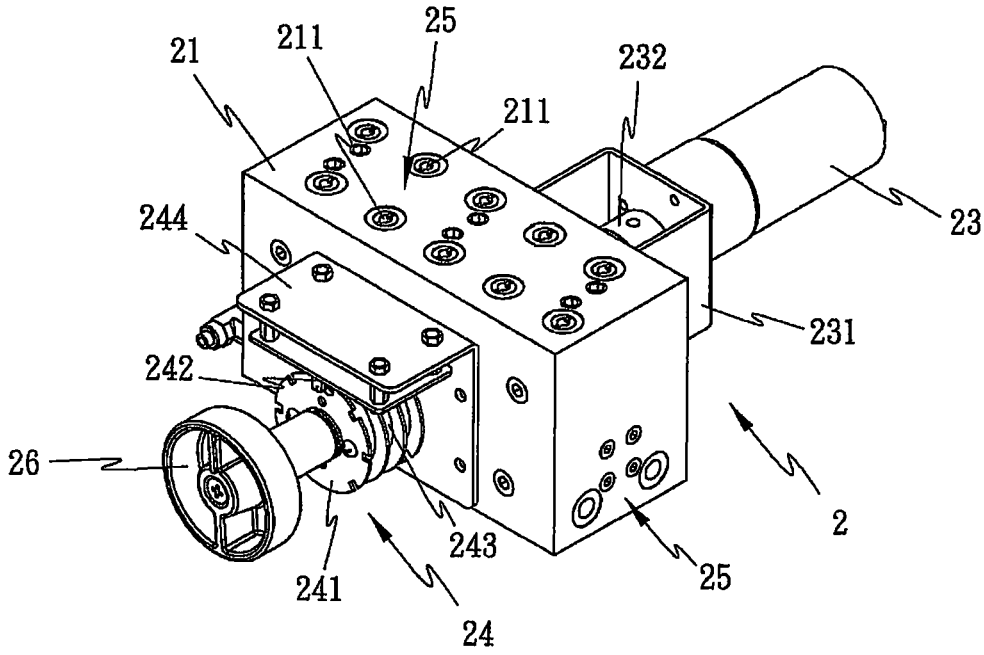
FIG. 4 is an assembled view of the switch valve.

Referring to FIGS. 3 and 4, the switch valve 2 is mounted in a base of the operating table for switch bi-directionally oil passages between the bidirectional hydraulic pumping device 1 and the movable units 3. The switch valve 2 comprises a valve block 21, a rotating shaft 22, a motor 23 and a valve detecting element 24.

Figure 5:
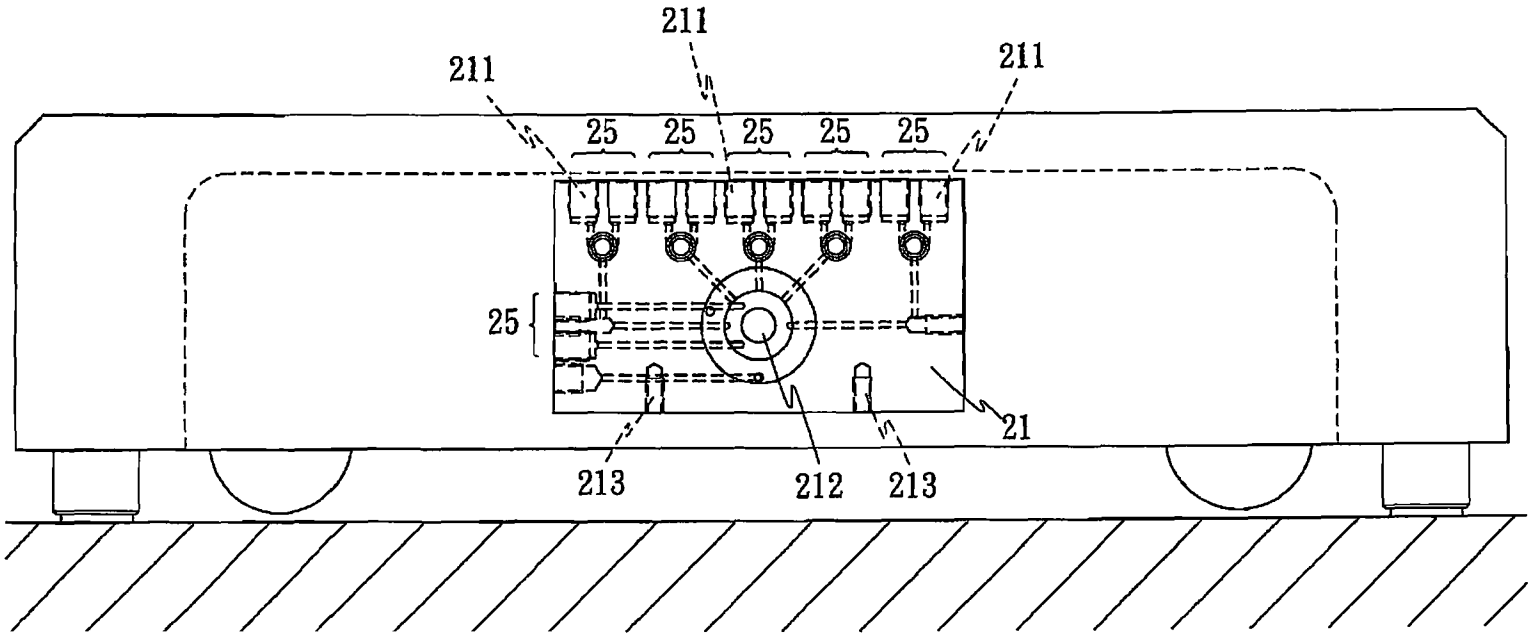
FIG. 5 schematically shows a valve block of the switch valve.

The valve block 21 is substantially rectangular, and defines at least three outbound valve positions 25 on the valve block's top surface thereof, as shown in FIG. 5, which is parallel to the inside bottom of the base, which the valve block is attached to; therefore, the valve block can be thinner and be putted into a thinner table base. When necessary, an additional outbound valve position 25 is defined in a valve block's 21 side surface parallel to the rotating shaft 22. Each outbound valve position 25, as well as the additional outbound valve position 25, includes a pair of coupling holes 211 which mutually serve as oil inlet or oil outlet of the movable units 3. A step-like shaft hole 212 is defined through a front surface and a rear surface of the valve block 21 for accommodating the rotating shaft 22.

The rotating shaft 22 is a shaft pole for switching valve positions of the switch valve 2. The rotating shaft 22 extends horizontally through the valve block 21 and is able to select a corresponding outward valve position 25. Oil seals 221 are provided on both ends of the rotating shaft 22 for sealing the shaft hole 212 of the valve block 21. An end of the rotating shaft 22 extends out of the valve block 21 and connects with the motor 23, while the other end of the rotating shaft 22 extends out of the valve block 21 and connects with the valve detecting element 24.

A bracket 231 is provided to fasten the motor 23 onto the valve block 21. The axle of the motor 23 connects with the rotating shaft 22 through a shaft linker 232.

Figure 6:
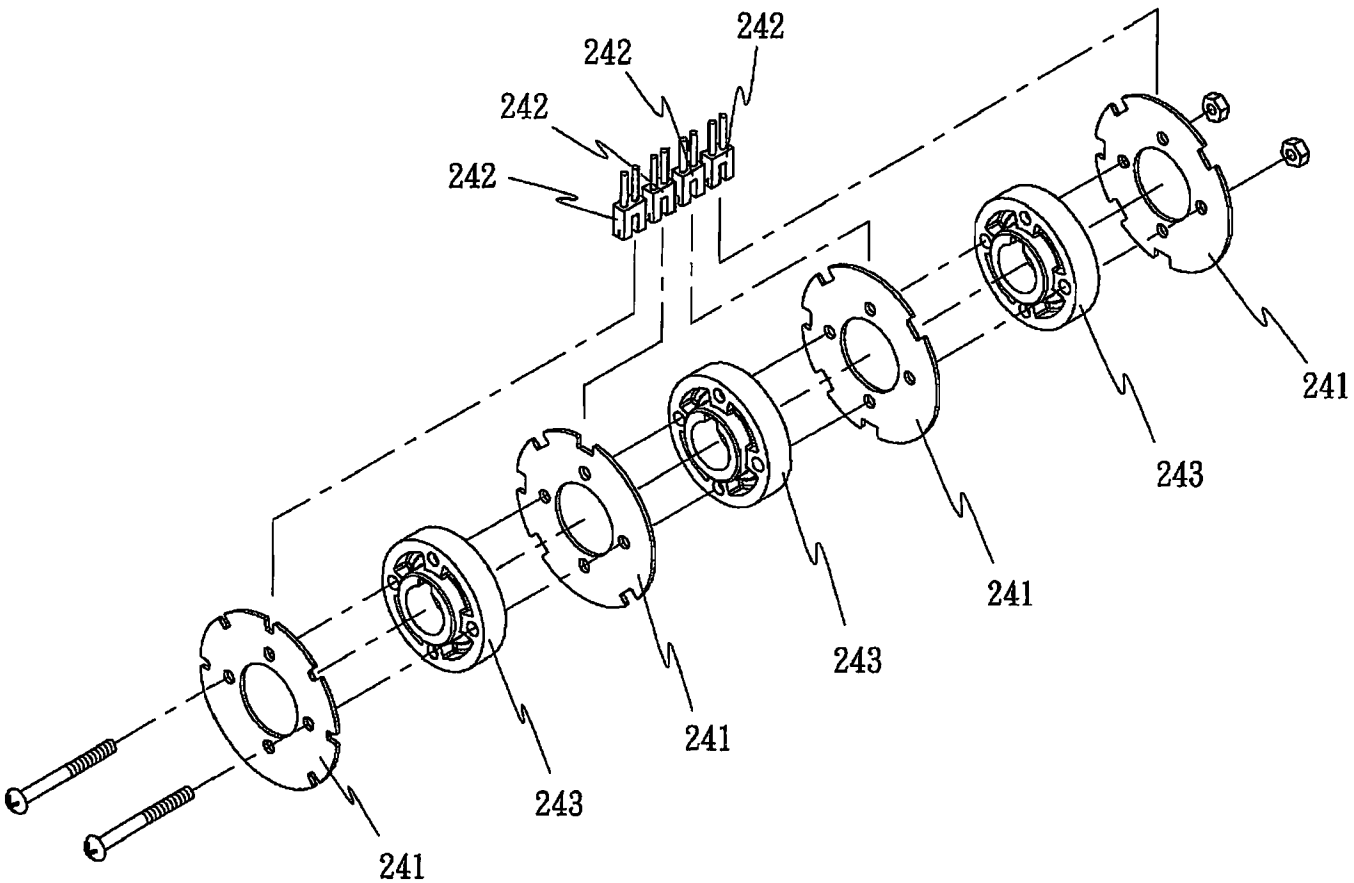
FIG. 6 is an exploded view of a valve detecting element of the bidirectional hydraulic system.

Referring to FIG. 6, the valve detecting element 24 includes detecting plates 241, detectors 242 and partitioning rings 243. The detecting plates 241 are partitioned by the partitioning rings 243, and are mounted on an end of the rotating shaft 22 (see FIG. 7). The detectors 242 are retained on the valve block 21 by a locking rack 244, and respectively straddle on edges of the detecting plates 241. According to one embodiment of the present invention, the detectors 242 are opto interrupters. When the detecting plates 241 rotate synchronous with the rotating shaft 22, sensing cutouts on edges of the detecting plates 241 issue sensing signals to the detectors 242. The sensing signals of the detecting plates 241 decode valve position of the rotating shaft 22 and position the rotating shaft 22 to correspond to the outbound valve positions 25 of the switch valve 2.

The movable units 3 are powered with hydraulic cylinders, and include multi-sectional tabletop rotation, tabletop sliding, descending and ascending, and table locking, and etc. The hydraulic cylinder of each movable unit 3 is connected with the coupling hole 211 of the switch valve 2 through an oil conduit. In this way the movable unit 3 corresponds to an outbound valve position 25.

When an movable unit 3 of the operating table is selected for actuation, the motor 23 rotates the rotating shaft 22. The rotating shaft 22 directs the oil supply of the bidirectional hydraulic pumping device 1 to a selected outbound valve position 25. The valve detecting element 24 at an end of the rotating shaft 22 is used to confirm if the rotating shaft 22 is positioned precisely. The selected outbound valve position 25 directs the oil supply of the bidirectional hydraulic pumping device 1 to the selected movable unit 3.

Furthermore, the valve block 21 of the switch valve 2 defines no downward oil holes (see FIG. 5). The shaft hole 212 and the rotating shaft 22 need not locate at a center of the valve block 21. The distance from the shaft hole 212 and the rotating shaft 22 to a bottom surface of the valve block 21 decreases, and therefore reduces overall height of the switch valve 2 and thickness of the base of the operating table.

Figure 7:
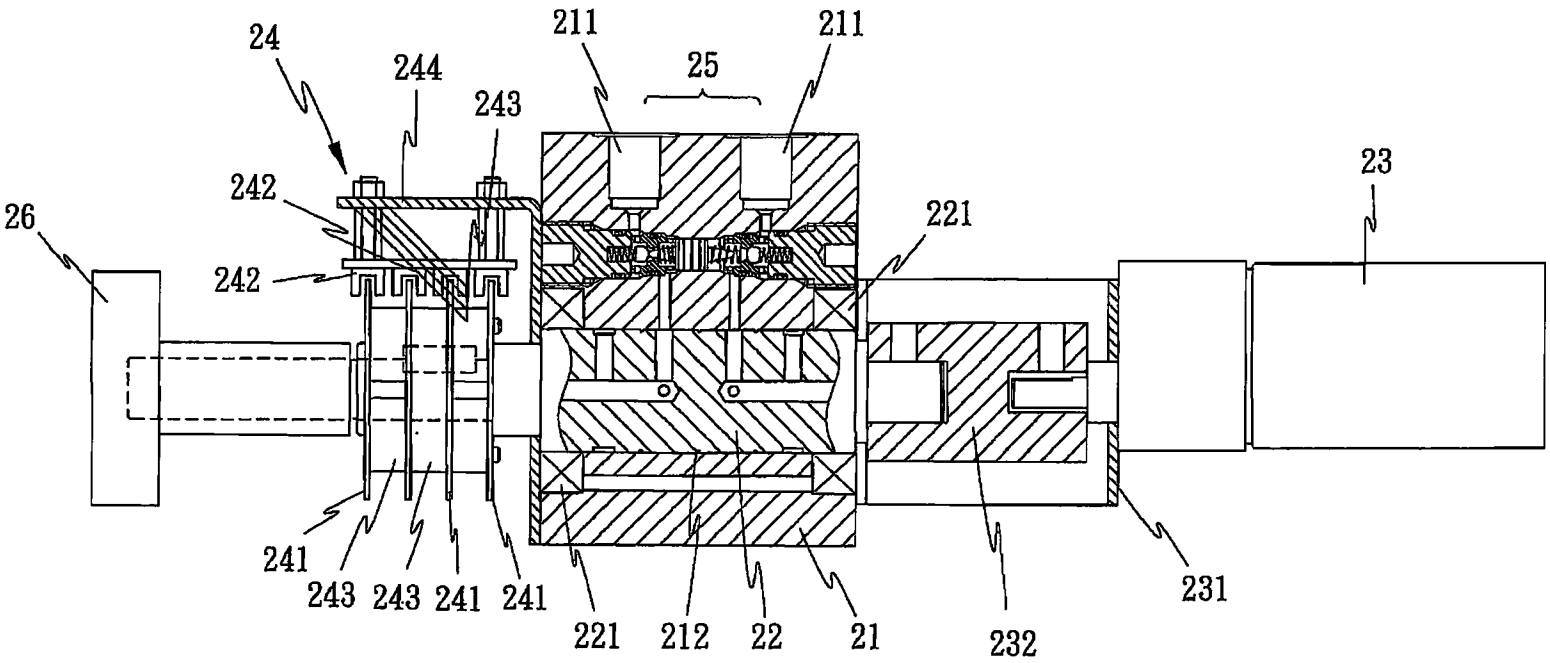
FIG. 7 is a cross-sectional assembled view of the switch valve.

Referring to FIG. 7, a rotating knob 26 is mounted on an end of the rotating shaft 22, and is rotatable manually from the base's exterior of the operating table. The rotating knob 26 serves as a manual operating part while the motor 23 of the switch valve 2 is out of work.

The motor 23 may be a servo motor or stepping motor, which is positioned accurately and is expensive. The motor 23 may also be an ordinary motor. An ordinary motor's inertia when being halted makes rotation angle of the rotating shaft 22 uncontrollable. Manufacturing tolerance of the switch valve 2 also takes effect on the rotation angle of the rotating shaft 22. In this case, the valve detecting element 24 can not position the rotating shaft 22 precisely. Thus, when an ordinary motor is used to drive the rotating shaft 22, a length-adjustable time counting method is applied to calculate stopping time of the motor so as to accurately control the rotation angle of the rotating shaft 22, and thus correctly control the rotating shaft 22 to aim at the required valve position.

All of the oil holes with the oil conduits are located on the top or a side of the valve block 21 of the switch valve 2 without any downward oil hole. A locking hole 213 (see FIG. 5) is defined at the bottom of the valve block 21 for locking the switch valve 2. The switch valve 2 can be fixed on the base through the locking hole 213 without a need of an additional metal plate, thereby greatly decreasing the cost for metal plates.

The bidirectional hydraulic system directs oil supply of the bidirectional hydraulic pumping device 1 to a selected an movable unit 3 through the switch valve 22. The switch valve 22 can be assembled onto the base of the operating table within a relatively lower mounting space, enabling reduction of the overall height of the base, and expends the up and down movement range of the operating table.

It is understood that the invention may be embodied in other forms without departing from the spirit thereof. Thus, the present examples and embodiments are to be considered in all respects as illustrative and not restrictive, and the invention is not to be limited to the details given herein.

It is of course to be understood that the embodiments described herein is merely illustrative of the principles of the invention and that a wide variety of modifications thereto may be effected by persons skilled in the art without departing from the spirit and scope of the invention as set forth in the following claims

What is claimed is:

1. A bidirectional hydraulic system comprising:

at least three movable units powered with multiple hydraulic cylinders;

a bidirectional hydraulic pumping device configured to supply hydraulic power for the movable units;

a switch valve configured to switch oil passages between the bidirectional hydraulic pumping device and the movable units wherein the switch valve comprises a valve block having a substantially rectangular shape, wherein multiple pairs of coupling holes are at multiple respective outbound valve positions on a top surface of the valve block, wherein each of the hydraulic cylinders connect with one of the outbound valve positions via an oil conduit, a rotating shaft extending horizontally through the valve block, wherein the rotating shaft is configured to select one of the outbound valve positions, and a motor connecting with the rotating shaft extending out of the valve block, wherein when one of the movable units is selected to work, the motor drives the rotating shaft to rotate, wherein the rotating shaft directs oil supply of the bidirectional hydraulic pumping device to a selected one of the outbound valve positions, wherein the selected one of the outbound valve positions directs the oil supply of the bidirectional hydraulic pumping device to the selected one of movable units; and a valve detecting element at an end of the rotating shaft, wherein the rotating shaft is configured to be positioned corresponding to the outbound valve positions, wherein the valve detecting element comprises multiple detecting plates mounted on the end of the rotating shaft, multiple detectors retained on the valve block and multiple partitioning rings partitioning the detecting plates, wherein each of the detectors straddles at an edge of one of the detecting plates.

2. The bidirectional hydraulic system of claim 1, wherein a pair of coupling holes is at an outbound valve position on a side surface of the valve block.

3. The bidirectional hydraulic system of claim 1 further comprising multiple oil seals at both ends of the rotating shaft, wherein the oil seals seal a shaft hole of the valve block, wherein the shaft hole receives the rotating shaft.

4. The bidirectional hydraulic system of claim 1, wherein the motor comprises a servo motor.

5. The bidirectional hydraulic system of claim 1, wherein the detectors comprise multiple opto-detectors.

6. The bidirectional hydraulic system of claim 1 further comprising a rotating knob at the end of the rotating shaft, wherein the rotating knob is configured to be rotated manually.

7. The bidirectional hydraulic system of claim 1, wherein the motor comprises a stepping motor.

* * * * *